US006040253A

United States Patent [19]

Hennecken

[11] Patent Number: 6,040,253

[45] **Date of Patent: *Mar. 21, 2000**

[54] PRESS PAD FOR HIGH-PRESSURE AND LOW-PRESSURE PRESSES

[75] Inventor: Bruno Hennecken, Aachen, Germany

[73] Assignee: Rheinische Filztuchfabrik GmbH, Stolberg/Rhld., Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/562,871

[22] Filed: Nov. 27, 1995

[30] Foreign Application Priority Data

Nov. 25, 1994 [DE] Germany ..... 94 18 984 U

[51] Int. Cl.[7] ..... D03D 15/00

[52] U.S. Cl. ..... 442/239; 139/425 R; 139/420 A; 100/297

[58] Field of Search ..... 139/408, 411, 139/413, 425 R, 420 A; 100/297; 442/239

[56] References Cited

U.S. PATENT DOCUMENTS

| | | | |
|---|---|---|---|
| 3,288,175 | 11/1966 | Valko | 139/425 R |
| 5,298,322 | 3/1994 | Hennecken et al. | 428/285 |

FOREIGN PATENT DOCUMENTS

| | | |
|---|---|---|
| 0 099 205 | 1/1984 | European Pat. Off. . |
| 0 488 071 | 6/1992 | European Pat. Off. . |
| 2 239 340 | 2/1975 | France . |
| 26 50 642 | 5/1978 | Germany . |
| 28 17 079 | 2/1979 | Germany . |
| 09 17 587 | 5/1991 | Germany . |
| 9203498 | 6/1992 | Germany . |
| 54-20732 | 7/1979 | Japan . |
| 62-199842 | 9/1987 | Japan . |
| 62-234696 | 10/1987 | Japan . |
| 62-234698 | 10/1987 | Japan . |
| 96/13376 | 5/1996 | WIPO . |

*Primary Examiner*—Christopher Raimund
*Attorney, Agent, or Firm*—Venable; Gabor J. Kelemen; Ashley J. Wells

[57] ABSTRACT

A press pad which is made of asbestos-free material includes at least one yarn of Group I in combination with at least one yarn of Group II, wherein Group I includes (A) yarn composed of filaments of at least one aromatic polyamide and filaments of at least one metallic material selected from the group consisting of metals and metal alloys; and (B) yarn composed of filaments of at least one metallic material selected from the group consisting of metals and metal alloys, and wherein Group II includes (A) filaments which are composed of one of at least one silicone polymer or a mixture of filaments of different silicone polymers and which are heat resistant; (B) filaments which are composed of one of at least one flexible plastic substance which is not a aromatic polyamide or filaments of a mixture of different flexible plastic substances which are not aromatic polyamides and which are heat resistant; (C) filaments which are composed of an outer layer and a metallic core, the outer layer being composed of filaments of at least one material from Group II (A) or (B), and the metallic core being composed of at least one filament of at least one metallic material selected from the group consisting of metals and metal alloys, and being one of fixedly connected with the outer layer or not fixedly connected with the outer layer; and (D) wrapped filaments which are composed of filaments of at least one material from Group II (A), (B), or (C) and which are wrapped by metallic filaments composed of at least one metallic material selected from the group consisting of metals and metal alloys.

6 Claims, 2 Drawing Sheets

PRESS PAD FOR HIGH-PRESSURE AND LOW-PRESSURE PRESSES

CROSS-REFERENCE TO RELATED APPLICATION

The present disclosure relates to the subject matter disclosed in German Application No. G 9418984.6 of Nov. 25, 1994, the entire specification of which is incorporated herein by reference.

BACKGROUND OF THE INVENTION

1. Field of the Invention

The invention relates to a press pad made of asbestos-free material for a great variety of different types of high-pressure and low-pressure presses. Such presses include short-cycle and multi-platen presses for the lamination of sheets of particle-board with sheets of, for example, MELAMINE (molded melamine-formaldehyde resins), etc., high-pressure presses for the production of high-pressure laminates, and other presses for many other applications. This list is exemplary only and is not intended to be exhaustive.

2. Description of the Related Art

The presses mentioned above are mechanical systems which work with different temperatures and pressures. The presses themselves, as well as the materials to be pressed, have more or less large tolerances. In such presses, press pads have the task of compensating for these tolerances and of transferring the pressing pressure uniformly to the entire surface of the materials to be pressed.

Additionally, press pads must have good thermal conductivity so that the heat which is necessary for the manufacture of the final product, usually a laminate, is transmitted with the smallest possible loss of heat.

Press pads must not only compensate for the mentioned tolerances and have good thermal conductivity, but they must also be able to withstand the sometimes considerable pressures and temperatures in the presses, and they must retain these characteristics over prolonged periods.

The following types of press pads are predominantly used at the present time: pads made of asbestos-free yarns comprising metal threads, identical yarns in combination with pure metal yarn, pure metal pads, kraft papers, and press pads with fleece lining (see German Published Patent Application No. G 92 03 498.5). This list is exemplary only and is not intended to be exhaustive.

It is an object of the present invention to provide a press pad which, compared to the press pads used in the past, is characterized by a particularly marked improvement of the padding action and, at the same time, good heat transfer.

It is another object of the present invention to provide a press pad that has a combination of padding action and heat transfer characteristics that may be varied while continuing to exhibit a particularly marked improvement of the padding action and, at the same time, good heat transfer.

SUMMARY OF THE INVENTION

These and other objects are accomplished by the present invention which provides a press pad which is made of asbestos-free material, comprising: at least one yarn of Group A in combination with at least one yarn of Group B, wherein Group A includes: (1) yarn comprised of filaments of at least one aromatic polyamide, optionally containing additional yarn material for customizing the yarn to use of the press pad, and filaments of at least one metallic material selected from the group consisting of metals and metal alloys; and (2) yarn comprised of filaments of at least one metallic material selected from the group consisting of metals and metal alloys, and wherein Group B includes: (1) filaments which are comprised of one of at least one rubber or a mixture of filaments of different rubbers and which are heat resistant; (2) filaments which are comprised of one of at least one silicone polymer or a mixture of filaments of different silicone polymers and which are heat resistant; (3) filaments which are comprised of at least one flexible plastic substance or a mixture of filaments of different flexible plastic substances and which are heat resistant; (4) filaments which are comprised of an outer layer and a metallic core, the outer layer being composed of filaments of at least one material from Group B (1), (2), or (3), and the metallic core being composed of at least one metallic material selected from the group consisting of metals and metal alloys, and being one of fixedly connected with the outer layer or not fixedly connected with the outer layer; (5) wrapped filaments which are comprised of at least one material from Group B (1), (2), (3), or (4) and which are wrapped by filaments composed of at least one metallic material selected from the group consisting of metals and metal alloys; and (6) filaments of at least one aromatic polyamide. The press pad is preferably a woven fabric and may be a singe-layered weave or a multi-layered weave.

Alternatively, the press pad includes filaments of Group B (6) and filaments of at least one of Group B (1) to (5) above.

As used herein, a yarn may be composed of one or more filaments. Filaments may be composed of single strands or threads, or multiple strands or threads which are aligned, bundled, twisted, or otherwise combined. Similarly, strands or threads may be composed of single or multiple fibers which are aligned, bundled, twisted, or otherwise combined.

In Group A (1), the yarn comprised of filaments of at least one aromatic polyamide may be mixed with other yarn materials as required by the application to which the press pad is put and filaments composed of at least one metallic material may be included in any proportion in the yarn. The other yarn materials may include, for example, filaments comprised of substances which behave as release agents to prevent sticking of the press pad to the materials being laminated.

Preferably, the amount of filaments composed of at least one metallic material are present in an amount which does not exceed the amount at which the metallic filaments cut through the press pad in any substantial way and reduce the useful lifetime of the press pad. Metal filaments in amounts ranging up to about 70 weight % of the yarn can generally be employed, but greater amounts can be advantageously employed for certain applications. For example, low pressure press applications can employ press pads composed of a textile fabric made of a yarn of aromatic polyamide and containing from about 80 to 95 weight % of copper filaments.

The following combinations of yarns may be selected depending on application requirements. Yarns of Group A (1) with one or several of the yarns/filaments of Group B. Yarns of Group A (2) with one or several yarns/filaments of Group B. Yarns of both Group A (1) and Group A (2) with one or several of the yarns/filaments of Group B. The invention does not, however, include the combination of the yarns of Group A with yarn comprised of filaments of at least one aromatic polyamide without filaments of at least one metallic material, because this is already known from U.S.

Pat. No. 5,298,322 issued to Bruno Hennecken and Paul Schmitz, the disclosure of which is incorporated herein by reference.

The diameter of the yarns of Group B (1) to (6) are selected based on the padding action required or desired for an application. The thickness of the press pad and thus the accompanying padding action may also be accomplished by providing single-layered or, if required, multi-layered weaves.

Occasionally, the thermal conductivity of the press pad is of secondary importance, for example, during very long pressing times. In such cases, the following material combinations may also lead to advantageous results. A combination of the yarn of Group B (6) with a yarn of Group B (1)–(5) may be advantageous. Also advantageous may be a combination of the yarn of Group B (6) with several of the yarns of Group B (1)–(5).

The filaments of at least one metallic material may be composed of virtually any metal or metal alloy which may be drawn or formed into fibers or filaments. These include, by way of example but not limitation, copper and brass, respectively. The metallic core of the material of Group B (4) may be similarly constituted and may be comprised of a mono-filament or of multi-filaments bundled, twisted or otherwise grouped together.

BRIEF DESCRIPTION OF THE DRAWINGS

The invention is explained in greater detail in the following presentation of exemplary embodiments from which ensue further important characteristics taken with the drawings in which.

DESCRIPTION OF THE PREFERRED EMBODIMENTS

Figure 1:
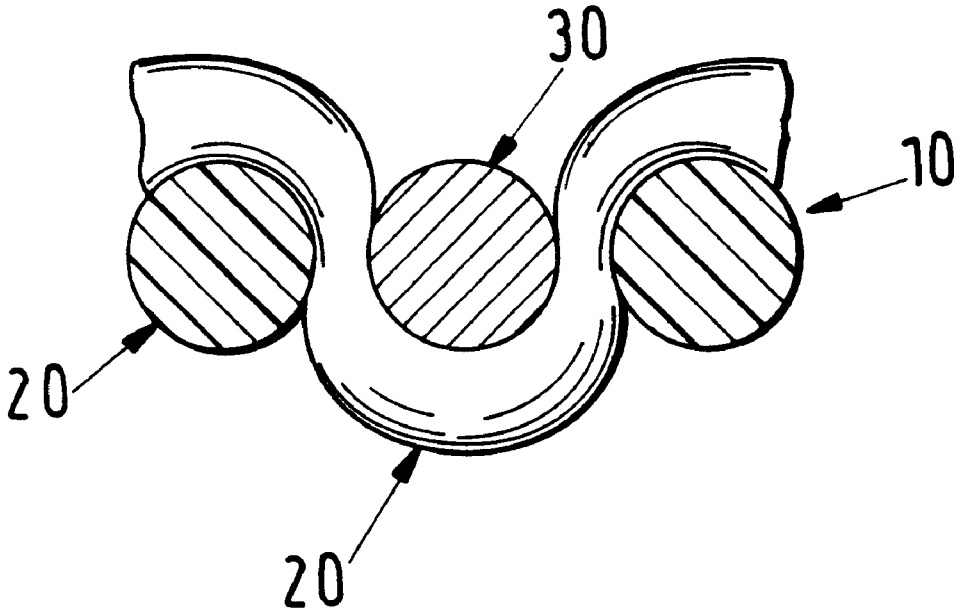
FIG. 1 is a cross-sectional view through a woven fabric suitable for use as a press pad according to the invention.

The following exemplary embodiments illustrate important characteristics in addition to those given in the foregoing description and the drawings. The drawing figures illustrate preferred embodiments of a press pad according to the invention.

In FIG. 1, press pad 10 has interwoven yarns 20 made from, for example, aromatic polyamide filaments and heat resistant filaments 30 made of, for example, rubber, silicone polymers, or flexible plastic substances.

Figure 2:
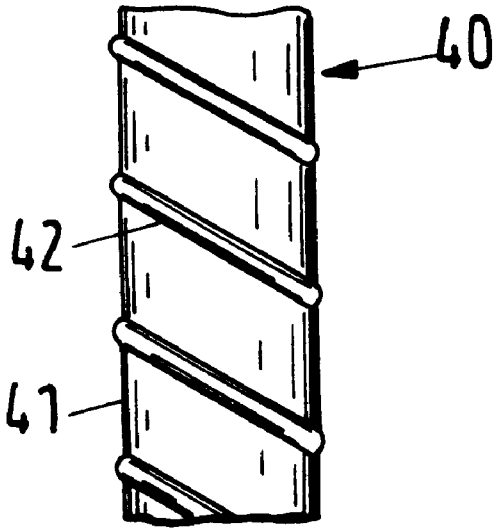
FIG. 2 shows a view of a metal wrapped filament according to the invention.

According to FIG. 2, yarn 40 includes a core 41 and filaments 42 wound around the core. For example, core 41 may a metallic core 41 made of one or more metallic filaments of, for example, copper or brass, and filaments 42 may be made of a heat resistant material, for example, rubber, silicone polymer, or flexible plastic substances, wound around the metallic core 41. Alternatively, core 41 may made of a heat resistant material, for example, rubber, silicone polymer, or flexible plastic substances, and filaments 42 may be made of a metallic material, for example, copper or brass, wound around the rubber or polymeric core 41.

Figure 3:
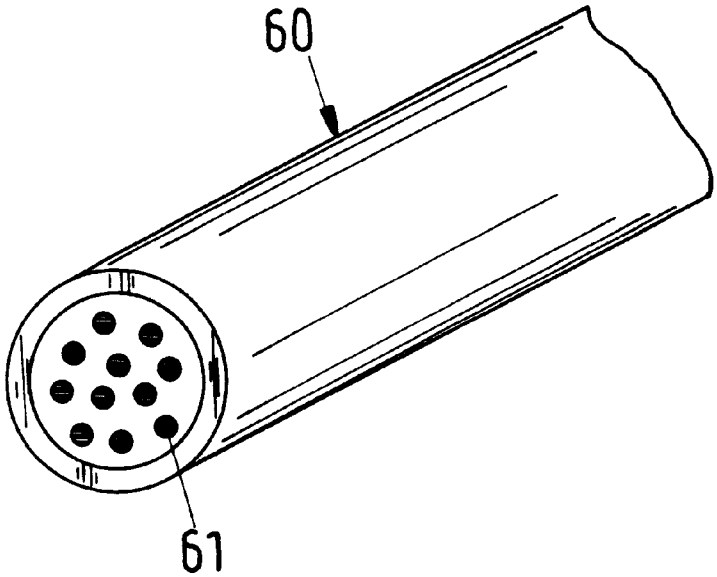
FIG. 3 shows a view of a filament comprised of an outer layer and a metal core composed of a plurality of metallic filaments.
Figure 4:
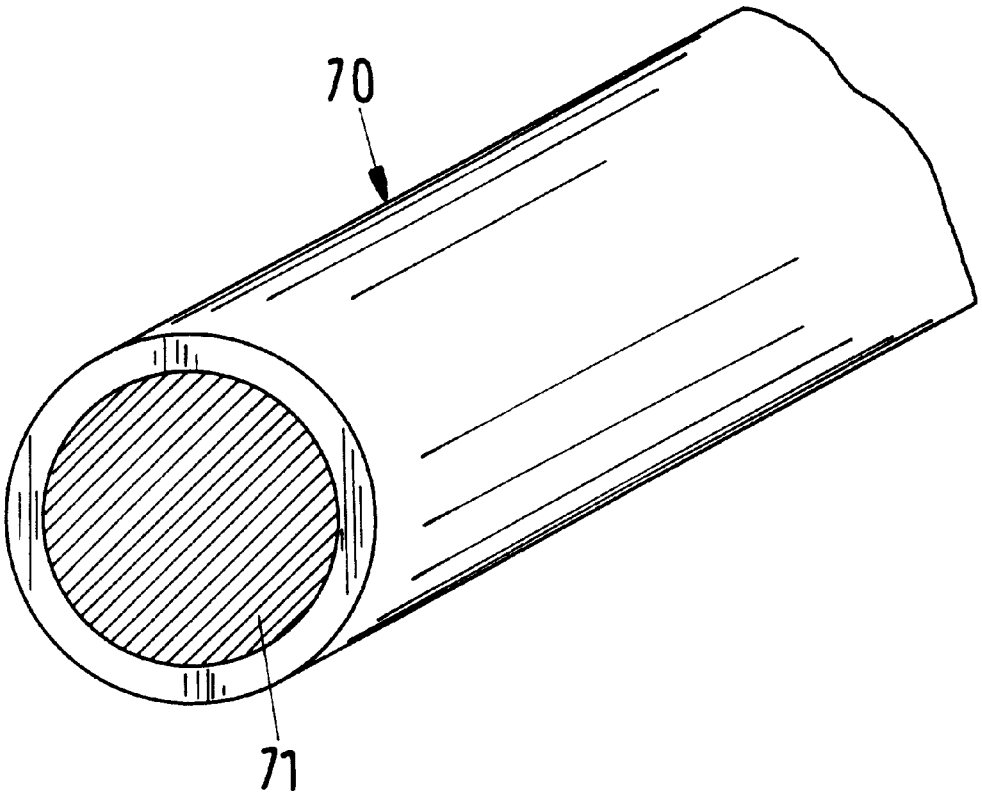
FIG. 4 shows a view of a filament comprised of an outer layer and a metallic core composed of a single metallic filament.

FIG. 3 illustrates an embodiment of a filament 50 including a metallic core 51 which includes a plurality of metallic filaments 51*a* made of, for example, strands of copper or brass, and an outer layer 52 made of a heat resistant material, for example, rubber, silicone polymer, or flexible plastic substance, provided around the metal core 51. The outer layer 52 may be molded or coated around the metallic core 51 so that the metallic core 51 is fixedly connected with the outer layer, or the outer layer 52 may be, for example, a sleeve 52 into which the metallic core 51 is positioned in a non-fixed manner, i.e., a non-adhering manner. FIG. 4 illustrates a variant of the embodiment of FIG. 3 in which metallic core 51 is a single filament 51*b* made of, for example, copper or brass.

The following provides examples for the use of or for combining the different filament and yarn materials of the press pads according to the invention.

In general, a press pad is expected to have two main characteristics, good padding action, i.e., good tolerance compensation, and good heat conductivity. In order to achieve good padding action, one needs a press pad which is as thick as possible. As a rule, however, heat transfer deteriorates as the thickness of the press pad increases. In order to achieve good thermal conductivity, one needs as much material with good heat conductivity as possible. If a press pad is made of pure metallic material, however, such a press pad has the best conceivable thermal conductivity but no padding action because a pad made of pure metallic material has little or no recuperative capacity, i.e., no resilience, and therefore no padding action.

Since users have different mechanical equipment (presses) and produce a great variety of different products, such as laminates of, for example, sheets of MELAMINE laminated to particle board sheets, press pads must meet a plurality of different requirements. New products produced by users generally require corresponding adjustments and new developments in the field of press pads too. Therefore it is necessary that a technical and cost-effective compromise between the two above-mentioned extremes of padding action and thermal conductivity be found for each application, and the present invention provides press pads having a wide range of characteristics.

EXAMPLE 1

For use in a situation in which thermal conductivity is of secondary importance and may be very low, such as when long pressing times are used, a pad with an extremely good padding action may be made according to the present invention of filaments of at least one aromatic polyamide and one or more filaments of the materials of group B (1) through (3).

Filaments of Group B (1) are comprised of at least one rubber which is heat resistant, for example, any of a group of man-made elastomers which approximate the properties of natural rubber, such as sodium polysulfide (THIOKOL), polychloroprene (neoprene), butadien-styrene copolymers (SBR), acrylonitrile-butadiene copolymers (nitrile rubber), ethylene-propylene-diene (EPDM) rubbers, synthetic polyisoprene (CORAL, NATSYN), butyl rubber (copolymer of isobutylene and isoprene), polyacrylonitrile (HYCAR), epichlorohydrin, and polyurethane.

Filaments of Group B (2) are comprised of at least one silicone polymer which is heat resistant, for example, any suitable polysiloxane, it being noted that silicones are synthetic rubbers as being within the group of man-made elastomers which approximate the properties of natural rubber as are the rubbers of Group B (1) mentioned above.

Filaments of Group B (3) are comprised of at least one flexible plastic substance which is heat resistant. Since press pads for use in high pressure pads experience pressures ranging between about 85 and about 100 kP/cm$^2$ and temperatures between about 130 to about 160° C., such flexible plastic substances must be selected based on whether such high pressure/high temperatures are to be experienced in use or whether lower pressures and lower temperatures are to be experienced. For high pressure/high temperature use, suitable flexible plastic substances include certain polyvinyl chlorides, nylons, fluorocarbons, linear polyethylene, urethane prepolymer, polystyrene, polypropylene, and cellulosic and acrylic resins. Specialty polymers can be used and include flexible plastic substances such as THERMOLASTIC, a copolymer of butadiene and styrene which does not require vulcanization and may be thermoplastically processed.

EXAMPLE 2

For use in a situation in which both very good thermal conductivity and good padding action is required, the press pad may be made according to the present invention of yarn comprised of filaments of at least one metallic material (Group A (2)) and wrapped filaments which are comprised of filaments of at least one material from Group B (1), (2), (3), or (4) and which are wrapped by metallic filaments composed of at least one metallic material.

EXAMPLE 3

For use in a situation in which balanced thermal conductivity and padding action is required, the press pad may be made according to the present invention of yarn comprised of Group A (1) and filaments of Group B (4). Filaments of Group B (4) are comprised of an outer layer and a metallic core in which the outer layer is composed of filaments of at least one material from Group B (1), (2), or (3), and the metallic core is composed of at least one filament of at least one metallic material selected from the group consisting of metals and metal alloys, and being one of fixedly connected with the outer layer or not fixedly connected with the outer layer.

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. A press pad which is made of asbestos-free material, consisting essentially of:

at least one yarn of Group I in combination with at least one yarn of Group II, wherein Group I includes:

(A) yarn comprised of filaments of at least one aromatic polyamide and filaments of at least one metallic material selected from the group consisting of metals and metal alloys; and (B) yarn comprised of filaments of at least one metallic material selected from the group consisting of metals and metal alloys, and wherein Group II includes:

(A) filaments which are comprised of one of at least one silicone polymer or a mixture of filaments of different silicone polymers and which are heat resistant, and (B) filaments which are comprised of an outer layer and a metallic core, the outer layer being composed of filaments of at least one material from Group II (A) or (B), and the metallic core being composed of at least one filament of at least one metallic material selected from the group consisting of metals and metal alloys, and being one of fixedly connected with the outer layer or not fixedly connected with the outer layer; and (C) wrapped filaments which are comprised of filaments of at least one material from Group II (A) or (B) and which are wrapped by metallic filaments composed of at least one metallic material selected from the group consisting of metals and metal alloys, and wherein the press pad does not include asbestos.

2. The press pad according to claim 1, wherein the press pad is a woven fabric.

3. The press pad according to claim 2, wherein the woven fabric is one of a single-layered weave or a multi-layered weave.

4. A press pad which is made of asbestos-free material, consisting essentially of:

at least one yarn of Group I in combination with at least one yarn of Group II, wherein Group I includes:

(A) yarn comprised of filaments of at least one aromatic polyamide, filaments of at least one metallic material selected from the group consisting of metals and metal alloys, and additional yarn material for customizing the yarn to use of the press pad; and (B) yarn comprised of filaments of at least one metallic material selected from the group consisting of metals and metal alloys, and wherein Group II includes:

(A) filaments which are comprised of one of at least one silicone polymer or a mixture of filaments of different silicone polymers and which are heat resistant, and (B) filaments which are comprised of an outer layer and a metallic core, the outer layer being composed of filaments of at least one material from Group II (A) or (B), and the metallic core being composed of at least one filament of at least one metallic material selected from the group consisting of metals and metal alloys, and being one of fixedly connected with the outer layer or not fixedly connected with the outer layer; and (C) wrapped filaments which are comprised of filaments of at least one material from Group II (A) or (B) and which are wrapped by metallic filaments composed of at least one metallic material selected from the group consisting of metals and metal alloys, and wherein the press pad does not include asbestos.

5. The press pad according to claim 4, wherein the press pad is a woven fabric.

6. The press pad according to claim 5, wherein the woven fabric is one of a single-layered weave or a multi-layered weave.

* * * * *